US005097554A

United States Patent [19]

McLaughlin

[11] Patent Number: 5,097,554

[45] Date of Patent: Mar. 24, 1992

[54] SCRAPER-HAMMER TOOL

[75] Inventor: Jack G. McLaughlin, Escondido, Calif.

[73] Assignee: Santa Tool Company, Inc., Portales, N. Mex.

[21] Appl. No.: 776,220

[22] Filed: Oct. 15, 1991

[51] Int. Cl.[5] ..... B25F 1/00

[52] U.S. Cl. ..... 7/105; 7/144; 30/123; 30/171

[58] Field of Search ..... 7/105, 143, 144, 170; 30/123, 169, 171, 287, 293, 294

[56] References Cited

U.S. PATENT DOCUMENTS 281,818 7/1883 Wylie ..... 7/144
1,598,420 8/1926 Brossett ..... 7/105
2,286,190 6/1942 Abrahamsen ..... 30/171
3,363,316 1/1968 Skarsten ..... 7/105

*Primary Examiner*—Roscoe V. Parker
*Attorney, Agent, or Firm*—John R. Ross

[57] ABSTRACT

A scraper-hammer tool. The tool has an essentially square-shaped four-blade scraper blade with two blades pointing upward and two blades pointing downward and a steel nob having the general shape of a roughly cylindrical hammerhead having a bolt socket in its base end. A single bolt holds the scraper blade and the nob onto the body of the scraper-hammer tool which includes a handle. With the blade in one direction the tool is a scraper. Turning the tool over turns it into a hammer to drive in nails which may be encountered on surfaces being scraped.

5 Claims, 3 Drawing Sheets 10
12

SCRAPER-HAMMER TOOL

This application relates to paint scraping devices nd is particular to two-hand operated paint scrapers.

BACKGROUND OF THE INVENTION

There are a great number of paint scrapers on the market. They range from devices like razor blades operated between one finger and a thumb to larger and more complicated scrapers. Warmer Manufacturing Company distributes a popular two-hand operated paint scraper. This scraper has a four-blade scraper blade, a body with a handle and a nob permanently attached to the body. The nob and the body both appear to be molded entirely of plastic except for a steel bolt socket in the nob which extends up through to the top of the nob. A bolt fits through a hole in the blade and screws into the socket to hold the blade fixed on one end of the scraper body. The bolt is tightened with a screw drive. The steel bolt socket at the top of the nob presents a steel cross sectional area at the top of the nob of about ½ inch. With careful aim it is possible to hammer in nails by hitting the nails with the metal portion of the nob.

SUMMARY OF THE INVENTION

The present invention provides a scraper-hammer tool. The tool has an essentially square-shaped four-blade scraper blade with two blades pointing upward and two blades pointing downward and a steel nob having the general shape of a roughly cylindrical hammerhead having a screw socket in its base end. A single screw holds the scraper blade and the nob into the body of the scraper-hammer tool which includes a handle. With the tool positioned in one direction, it is a scraper. Turning the tool over turns it into a hammer to drive in nails which may be encountered on surfaces being scraped.

DETAILED DESCRIPTION OF PREFERRED EMBODIMENT OF THE INVENTION

Figures 1A, 1B, 1C:
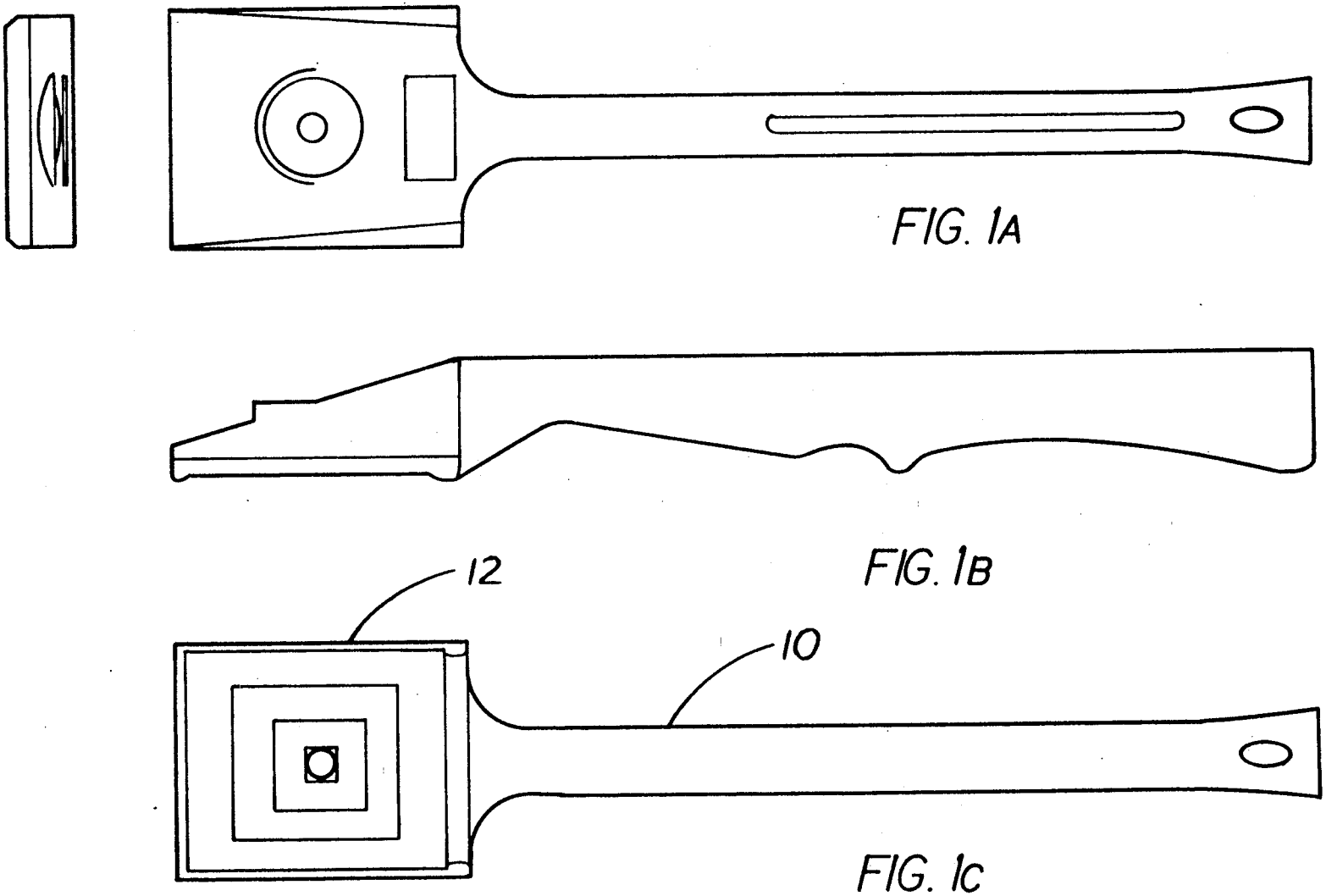
FIGS. 1A, B, and C are three views of the body of a preferred embodiment of the present invention.
Figure 2:
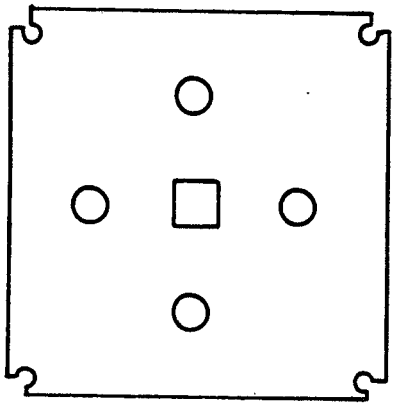
FIG. 2 is a drawing of the blade portion of the embodiment referred to above before it is bent into shape.
Figure 3A:
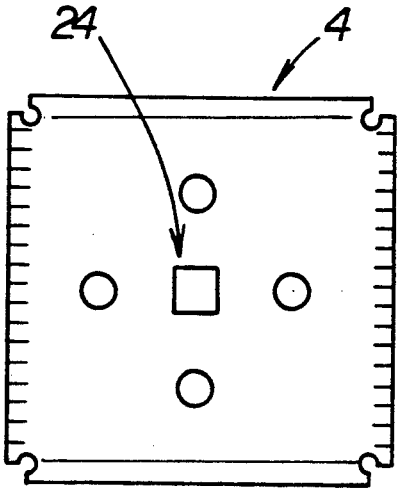
FIGS. 3A, B, and C are three views of the blade of a preferred embodiment of the present invention.
Figure 3C:
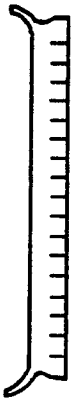
Figure 3B:
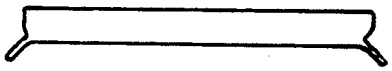
Figure 6:
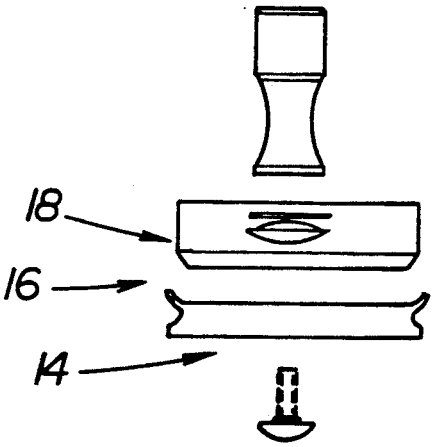
FIG. 6 is a drawing showing how the four parts of the above embodiment fit together.
Figure 7:
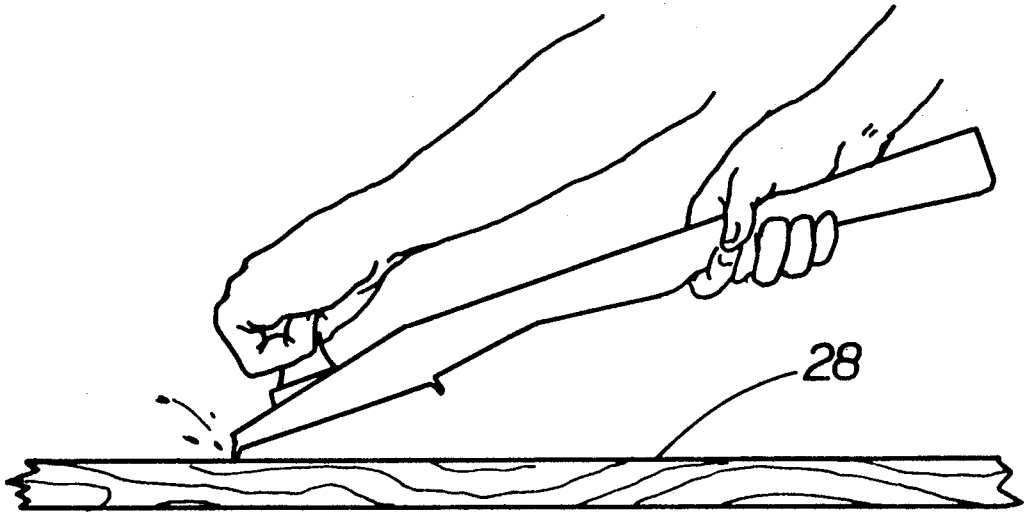
FIG. 7 shows the above embodiment used as a scraper.
Figure 8:
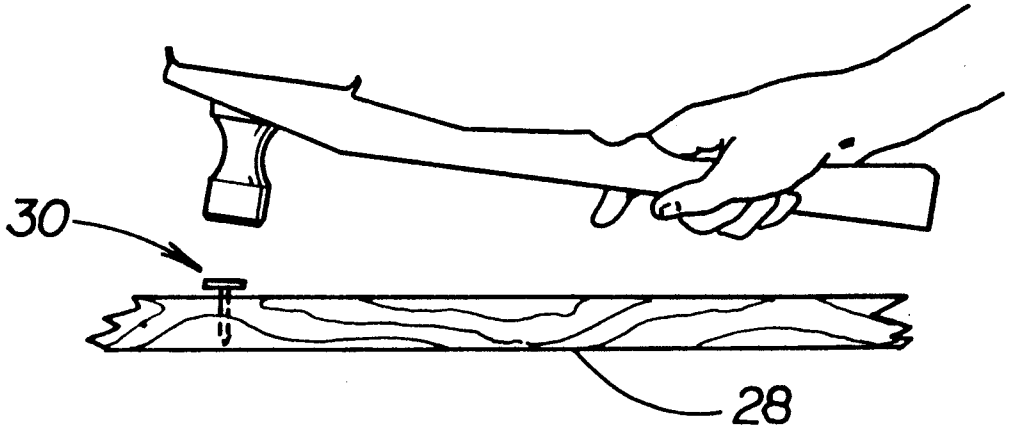
FIG. 8 shows the above embodiment used as a hammer.

A preferred embodiment of the present invention can be described by reference to the figures. The body shown in FIGS. 1A, B and C is molded entirely of polypropylene plastic. It consists of a handle portion 10 and a head portion 12. The handle portion is shaped to provide a comfortable grip for both scraping and hammering as shown in FIGS. 7 and 8. The head portion is shaped to fit the hammerhead nob 6 and blade 4. The blade 4 is stamped from a sheet of about 20 mil thick spring steel. The basic pattern is shown in FIG. 2. It is bent into the shape shown in FIGS. 3A, B and C. The cutting and shaping can be accomplished is one stamping operation. After stamping sharp scraping edges are ground onto the four blades. In this embodiment blade 4 consists of two serrated blades for rough scraping and two straight blades for fine scraping. When the blade is fitted for rough scraping, both serrated blades are pointed downward as shown at 14 in FIG. 6 and the straight blades are pointed upward and fit onto the head portion of the body which is molded to fit the shape of the blade as shown at 18 in FIG. 6.

Figure 5A:
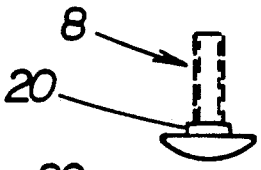
FIGS. 5A and B are two views of a screw used to hold the parts of the present invention together.
Figure 5B:
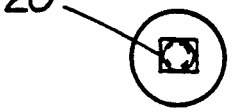

The hammerhead is machined from a 1¼ inch diameter tool steel rod. Its top is generally shaped like a typical hammerhead. The bottom portion contains a screw socket for a 5/16 inch carriage bolt. The bolt which is ¾ inch long is shown in FIGS. 5A and B. The hammerhead is preferably heat treated after machining to increase its hardness.

Figure 4A:
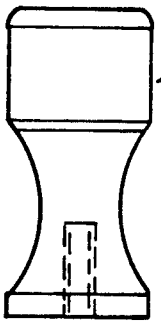
FIGS. 4A and B are two views of the hammerhead nob of the present invention.
Figure 4B:
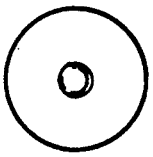

Bolt 8 comprises a 5/16 inch square ridge shown at 20 in FIGS. 5A and B. The square ridge fits into square hole 22 shown in FIG. 4 at 24. This hole is very slightly larger than 5/16 inch. This blade 4 is prevented from twisting by the fit of square ridge 20 on screw 8 and square hole 24 and by the fit of the up blade and the ridge 18 on the head of body 2 as shown in FIG. 6. The blade is tightened by twisting hammerhead nob 6. A screw driver is not required.

The assembly is shown in FIG. 7 being used as a scraper scraping paint off board 28. Note that the serrated blade is "up" in the drawing and the straight blade is down for fine scraping. FIG. 8 shows the tool used as a hammer to hammer in a nail 30 in board 28.

Having the hammerhead on the back of the blade is a tremendous time saver, because the worker does not have to stop scraping to get a hammer when he comes to a nail. Driving in the nails increases the lift of the blades. The nob is heavier than nobs of prior art devices. This extra weight makes scraping easier. These three elements makes the present invention a significant advance over the prior art.

While the above description contains many specificities, the reader should not construe these as limitations, but merely as exemplifications of the preferred embodiments thereof. Those skilled in the art will envision many other possible variations are within its scope. Accordingly the reader is requested to determine the scope of the invention by the appended claims and their legal equivalents, and not by the examples which have been given.

I claim:

1. A scraper-hammer tool comprising:

an essentially square-shaped scraper blade, said square shape defining a horizontal plane and comprising four blades with two blades pointing in a direction of about 45 degrees upward from said plane and two blades pointing downward about 45 degrees from said plane, a steel nob having the general shape of a roughly cylindrical hammerhead defining a hammer end and a base end and having a screw socket in its base end, a body comprising a handle and a head portion comprising a screw hole and defining a top and a bottom and molded to fit said blade at its bottom and molded to fit said nob at its top, a screw sized to fit through said hole in said blade, through said hole in said head portion of said body and to screw into said socket in said steel nob.

2. A scraper-hammer tool as in claim 1 wherein said nob is comprised entirely of tool steel.

3. A scraper-hammer as in claim 2 wherein said nob is heat treated after machining.

4. A scraper-hammer as in claim 3 wherein said blade is comprised of sprig steel.

5. A scraper-hammer as in claim 1 wherein said body is molded of polyurathane plastic.

* * * * *